US009745986B2

(12) United States Patent
Shin et al.

(10) Patent No.: US 9,745,986 B2
(45) Date of Patent: Aug. 29, 2017

(54) COMPRESSION SYSTEM

(71) Applicant: HANWHA TECHWIN CO., LTD., Changwon-si (KR)

(72) Inventors: Bong-Gun Shin, Changwon (KR); Jin-Soo Lee, Changwon (KR); Jong-Jae Cho, Changwon (KR); Seung-hoon Lee, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 668 days.

(21) Appl. No.: 13/952,704

(22) Filed: Jul. 29, 2013

(65) Prior Publication Data

US 2014/0219775 A1 Aug. 7, 2014

(30) Foreign Application Priority Data

Feb. 5, 2013 (KR) ..... 10-2013-0012940

(51) Int. Cl.
*F04D 19/02* (2006.01)
*F04D 25/16* (2006.01)

(52) U.S. Cl.
CPC ..... *F04D 19/02* (2013.01); *F04D 25/163* (2013.01); *Y10T 29/49245* (2015.01)

(58) Field of Classification Search
CPC ..... F04D 19/02; F04D 25/02; F04D 25/163; F04D 29/266; F04D 29/286
See application file for complete search history.

(56) References Cited

U.S. PATENT DOCUMENTS 4,219,306 A 8/1980 Fujino et al.
5,490,760 A * 2/1996 Kotzur ..... F01D 15/12 415/115
5,611,663 A 3/1997 Kotzur
7,681,623 B2 * 3/2010 Janssen ..... B22D 19/00 164/122
2008/0240918 A1 * 10/2008 In ..... F04D 25/163 415/214.1

FOREIGN PATENT DOCUMENTS

JP 8-189494 A 7/1996

OTHER PUBLICATIONS

Sundyne Pinnacle LF 2000—hereafter Sundyne—(Printed year 2011; retrieved online Feb. 3, 2016; earliest date of record made available online Apr. 25, 2012; http://www.sundyne.com/StaticFiles/Sundyne_Content/Asset_Wrapper/Static_Files/Sundyne_Pinnacle_Centrifugal_Compressor_Data_Sheet.pdf).*

* cited by examiner

*Primary Examiner* — Gregory Anderson
*Assistant Examiner* — Juan G Flores
(74) *Attorney, Agent, or Firm* — Sughrue Mion, PLLC

(57) ABSTRACT

Provided is a compression system including: at least one impeller; a gear train configured to the at least one impeller; a main drive shaft configured to drive the gear train; and a housing comprising an impeller container configured to house the at least one impeller and a gear train container configured to house the gear train.

4 Claims, 5 Drawing Sheets

COMPRESSION SYSTEM

CROSS-REFERENCE TO RELATED PATENT APPLICATION

This application claims priority from Korean Patent Application No. 10-2013-0012940 filed on Feb. 5, 2013, in the Korean Intellectual Property Office, the disclosure of which is incorporated herein by reference in its entirety.

BACKGROUND

1. Field

Apparatuses and methods consistent with exemplary embodiments relate to a compression system.

2. Description of the Related Art

Compressors for compressing fluids such as air, gases, and steam are used in various fields and there are many kinds thereof.

In the related art, compressors are classified into a volumetric type and a turbo type, and in more detail, reciprocating compressors, rotary screw compressors, turbo compressors, diaphragm compressors, and rotary sliding vane compressors.

Such compressors may be used independently, but according to needs of a designer, several compressors may be combined to form a multi-stage system, which is capable of providing a greater compression ratio.

On the other hand, Korean Patent Publication No. 1997-0021766 discloses a turbo compressor in which a gearbox and scrolls are separately manufactured, and the gearbox houses a train of gears and the scrolls houses impellers.

SUMMARY

One or more exemplary embodiments provide a compression system having an inner configuration whose layout is simple.

According to an aspect of an exemplary embodiment, there is provided a compression system including: at least one impeller; a gear train configured to drive the at least one impeller; a main drive shaft configured to drive the gear train; and a housing comprising an impeller container configured to house the at least one impeller and a gear train container configured to house the gear train.

The at least one impeller may include at least two in number, and the at least two impellers may be arranged in series.

The gear train may include: a bull gear connected to the main drive shaft; and at least one pinion gear engaged with the bull gear.

The at least one pinion gear may be connected to an impeller shaft configured to rotate the at least two impellers.

The housing may comprise: an upper housing; and a lower housing coupled with the upper housing.

Each of the upper housing and the lower housing may be a one-piece casting housing.

The at least one impeller includes a plurality of impellers, and the housing may also include a flow path configured to transfer a fluid between the plurality of impellers in the housing.

The housing including the impeller container, the gear train container and the flow path may be a one-piece housing.

The housing including the impeller container and the gear train container may be a one-piece housing.

The at least one impeller comprises a plurality of impellers, wherein the compression system may further include at least two compression units, and wherein each of the compression units may include at least two impellers of the plurality of impellers.

The housing may further include at least one connecting pipe configured to connect the at least two compression units.

According to an aspect of another exemplary embodiment, there is provided a method of manufacturing a compression system, the method including: preparing an upper housing and a lower housing, each of the upper and lower housings including an impeller container and a gear train container; installing an impeller in the impeller container of the lower housing and installing a gear train in the gear train container of the lower housing; and coupling the upper housing with the lower housing.

The upper housing and the lower housing may be formed by using a casting method.

The preparing the upper housing and lower housing may include casting each of the upper and lower housings having the impeller container and the gear train container as a one-piece casting.

The impeller may include a plurality of impellers, and the each of the upper and lower housings further comprises a flow path configured to transfer a fluid between the plurality of impellers.

The preparing the upper housing and lower housing may include casting each of the upper and lower housings having the impeller container, the gear train container and the flow path as a one-piece casting.

BRIEF DESCRIPTION OF THE DRAWINGS

The above and/or other aspects will become more apparent by describing in detail exemplary embodiments thereof with reference to the attached drawings in which.

DETAILED DESCRIPTION

Figure 1:
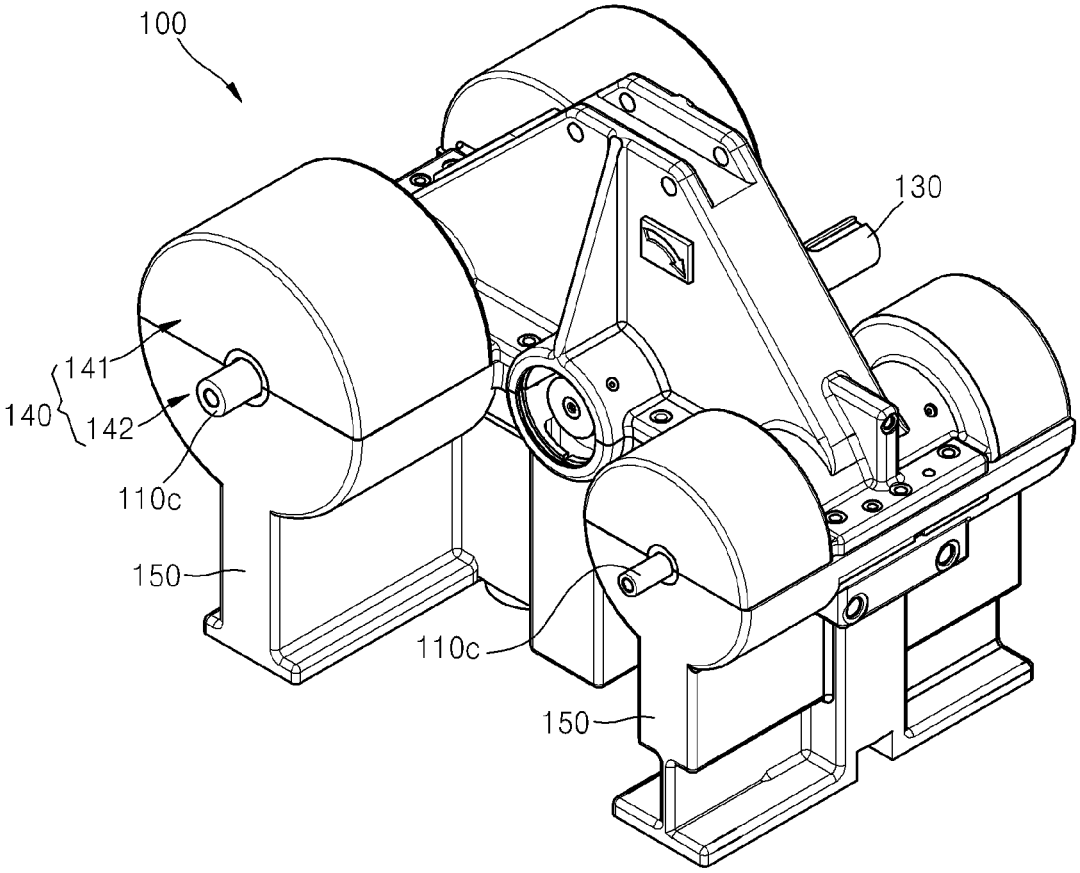
FIG. 1 is an external perspective view illustrating a compression system according to an exemplary embodiment.

Hereinafter, one or more embodiments will be described in detail with reference to accompanying drawings. Also, in drawings, same reference numerals denote same elements to avoid repetition.

Figure 2:
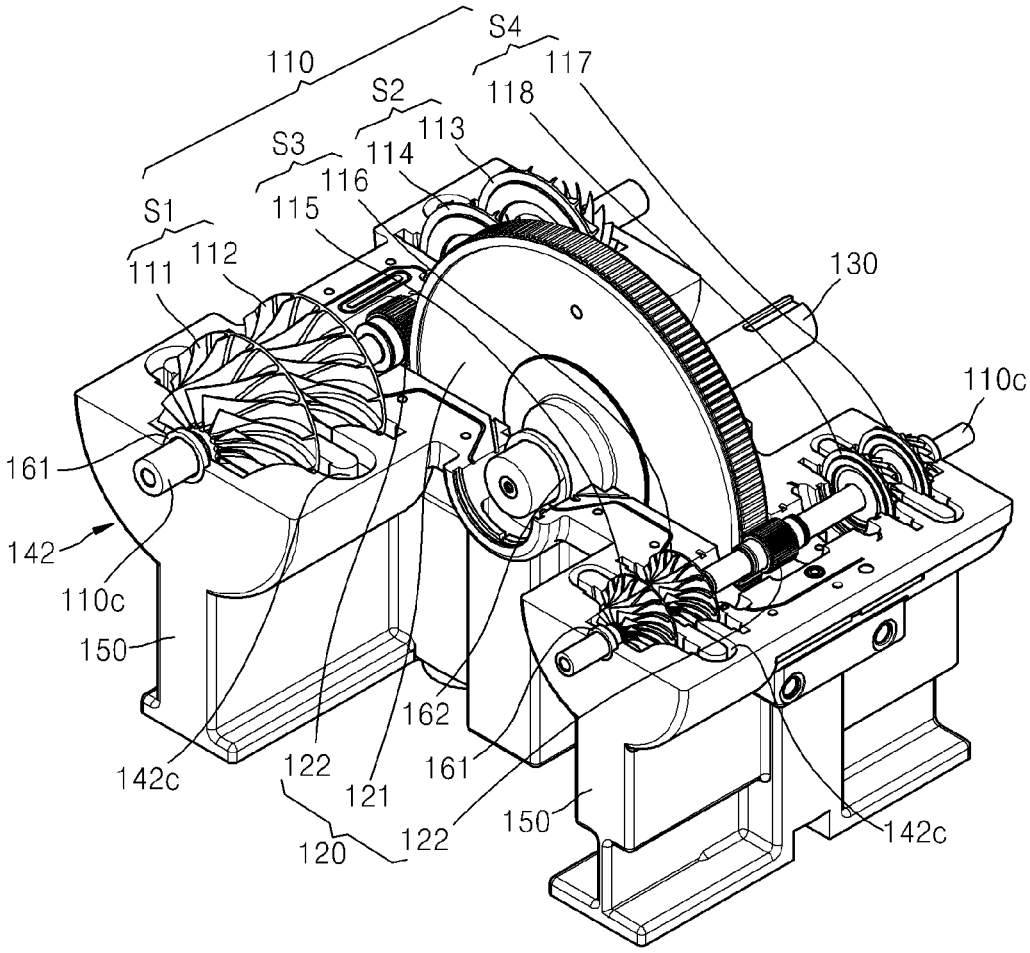
FIG. 2 is a schematic perspective view illustrating the compression system from which an upper housing is removed to show an inner configuration thereof.
Figure 3:
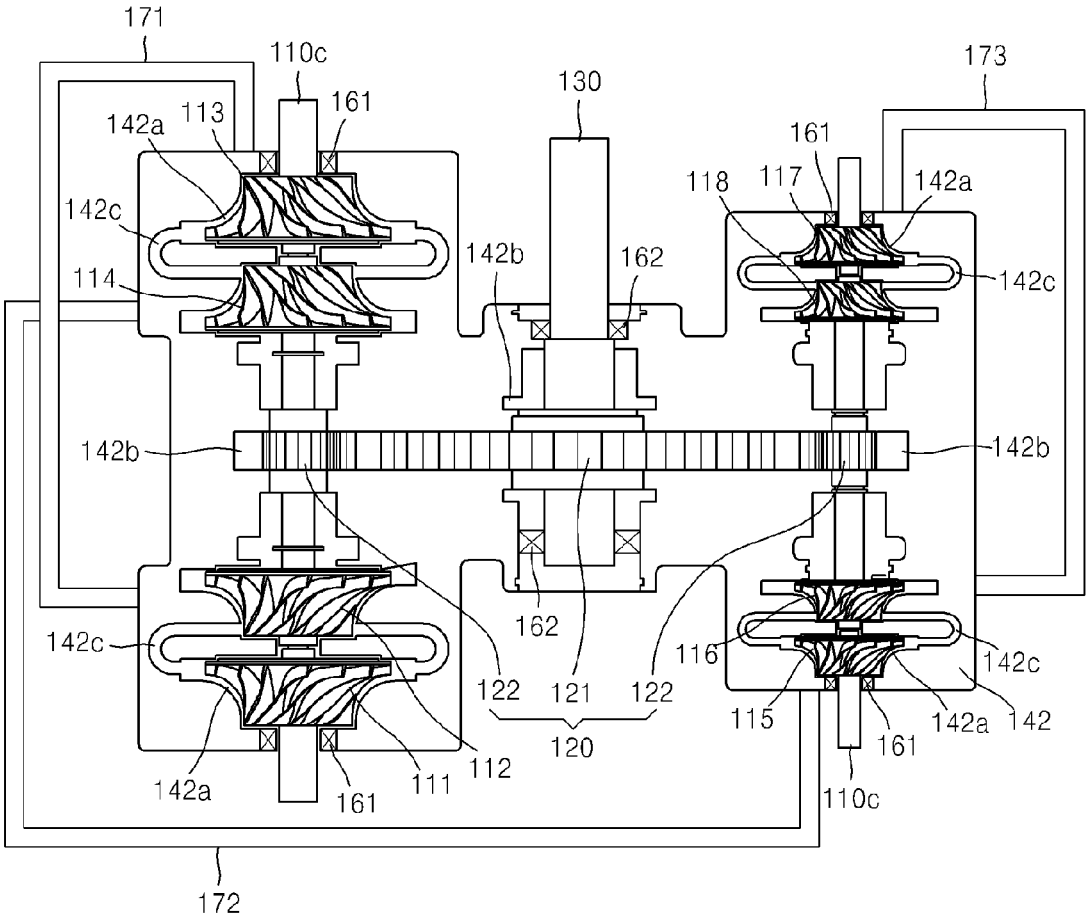
FIG. 3 is a schematic top view illustrating the inside of the compression system of FIG. 2.
Figure 4:
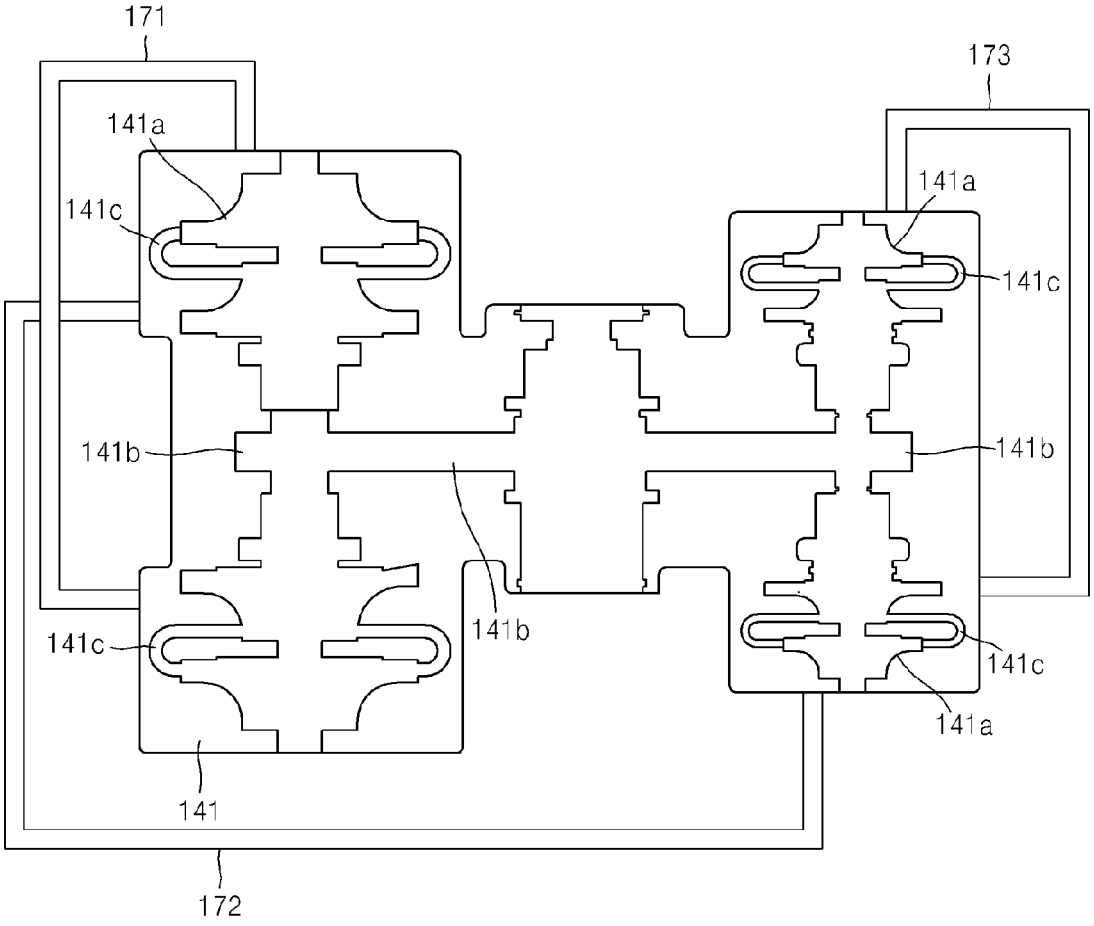
FIG. 4 is a top view illustrating the inside of the upper housing of the compression system of FIG. 1.
Figure 5:
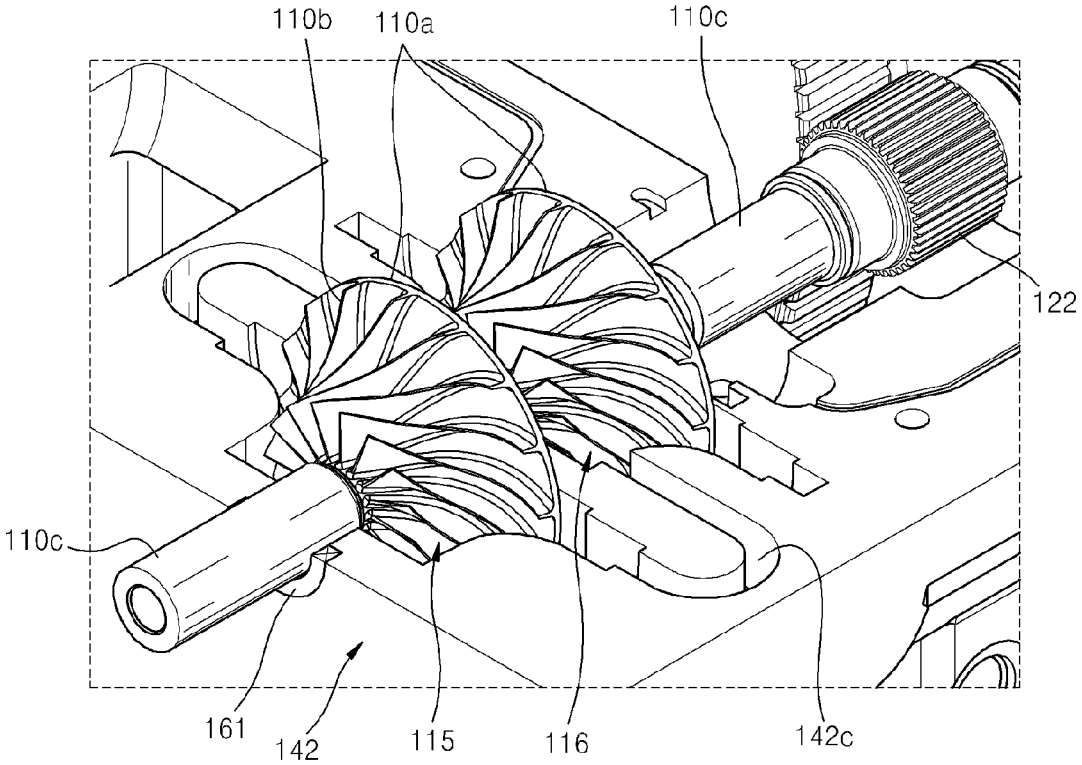
FIG. 5 is a schematic enlarged view illustrating a third compressing unit of the compression system of FIG. 2.

FIG. 1 is an external perspective view illustrating a compression system 100 according to an exemplary embodiment, FIG. 2 is a schematic perspective view illustrating the compression system 100 from which an upper housing 141 is removed to show an inner configuration thereof, FIG. 3 is a schematic top view illustrating the inside of the compression system 100 of FIG. 2, FIG. 4 is a top view illustrating the inside of the upper housing 141 of the compression system 100, and FIG. 5 is a schematic enlarged view illustrating a third compression unit S3 of the compression system 100.

As shown in FIGS. 1 through 5, the compression system 100 includes an impeller part 110, a gear train 120, a main drive shaft 130, a housing 140, and a support 150.

The impeller part 110 includes a first impeller 111, a second impeller 112, a third impeller 113, a fourth impeller 114, a fifth impeller 115, a sixth impeller 116, a seventh impeller 117, and an eighth impeller 118 arranged in the housing 140, and performs multi-stage compression.

The first impeller 111 and the second impeller 112 are arranged in series and form a first compression unit S1, the third impeller 113 and the fourth impeller 114 are arranged in series and form a second compression unit S2, the fifth impeller 115 and the sixth impeller 116 are in series and form the third compression unit S3, and the seventh impeller 117 and the eighth impeller 118 are in series and form a fourth compression unit S4.

Compression pressure of the first compression unit S1, the second compression unit S2, the third compression unit S3, and the fourth compression unit S4 sequentially increases. That is, the first compression unit S1 is a compressor unit which produces the lowest pressure ratio and the fourth compression unit S4 is a compressor unit which produces the highest pressure ratio. In other words, a compressed gas discharged from the first compression unit S1 is transferred to the second compression unit S2, a compressed gas discharged from the second compression unit S2 is transferred to the third compression unit S3, and a compressed gas discharged from the third compression unit S3 is transferred to the fourth compression unit S4, thereby performing multi-stage compression in an increasing manner. For this, a first connecting pipe (171) is installed outside the housing 140 to connect an outlet of the first compression unit S1 to an inlet of the second compression unit S2, a second connecting pipe (172) is installed outside the housing 140 to connect an outlet of the second compression unit S2 to an inlet of the third compression unit S3, and a third connecting pipe (173) is installed outside the housing 140 to connect an outlet of the third compression unit S3 to an inlet of the fourth compression unit S4 as shown in FIG. 4.

In the present exemplary embodiment, the impeller part 110 includes eight impellers, which are the first impeller 111, the second impeller 112, the third impeller 113, the fourth impeller 114, the fifth impeller 115, the sixth impeller 116, the seventh impeller 117, and the eighth impeller 118, and the eight impellers in pairs form the first compression unit S1, the second compression unit S2, the third compression unit S3, and the fourth compression unit S4. However, the exemplary embodiment is not limited thereto. In other words, there are no particular limitations to the numbers of impellers and compression units installed in the compression system 100. For example, the number of impellers installed in the compression system 100 may be twelve and the twelve impellers may be coupled together in threes and thus form four compression units.

As a type of the impeller part 110, there is a type that uses centrifugal impellers. As shown in FIG. 5, each impeller of the impeller part 110 includes a base plate 110*a*, a plurality of blades 110*b* installed on the base plate 110*a*, and a shaft 110*c* connected to the base plate 110*a*.

The shaft 110*c* is connected to a pinion gear 122 and receives power therefrom, the shaft 110*c* being supported by using a first bearing 161. In the present exemplary embodiment, there are two shafts 110*c*, as shown in FIG. 3, the left shaft 110*c* is installed in the first impeller 111, the second impeller 112, the third impeller 113, and the fourth impeller 114 and the right shaft 110*c* is installed in the fifth impeller 115, the sixth impeller 116, the seventh impeller 117, and the eighth impeller 118.

In the present exemplary embodiment, centrifugal impellers are used but the exemplary embodiments are not limited thereto. That is, the kind of the impellers used in the current exemplary embodiment is not limited to centrifugal impellers, but various kinds of impellers such as an axial flow type and mixed-flow type may also be used.

On the other hand, the gear train 120 includes a bull gear 121 and two pinion gears 122 engaged with the bull gear 121.

The bull gear 121 receives power from the main drive shaft 130 and transmits the power to the pinion gears 122.

The pinion gears 122 receive the power from the bull gear 121 and transmit the power to the respective shafts 110*c* driving the impeller part 110.

In the present exemplary embodiment, the gear train 120 includes the one bull gear 121 and the two pinion gears 122 but the exemplary embodiment is not limited thereto. That is, a configuration of the gear train 120 may vary. For example, a gear train according to another exemplary embodiment may include two bull gears and four pinion gears.

The main drive shaft 130 drives the gear train 120, being connected to a shaft of a motor (not shown) generating power or connected to a shaft of a reducer (not shown) to transmit external power to the bull gear 121.

The main drive shaft 130 is inserted into an installation hole located in the center of the bull gear 121 and connected thereto, and the main drive shaft 130 is supported by using a second bearing 162.

The housing 140 includes the upper housing 141 and a lower housing 142.

As shown in FIG. 4, the upper housing 141 includes an impeller container 141*a*, a gear train container 141*b*, and a flow path 141*c* formed in a single body and the lower housing 142 also includes an impeller container 142*a*, a gear train container 142*b*, and a flow path 142*c* formed in a single body as shown in FIG. 5.

The impeller containers 141*a* and 142*a* face each other to form a space for containing the impeller part 110, and the gear train containers 141*b* and 142*b* face each other to form a space for containing the gear train 120.

Also, the flow paths 141*c* and 142*c* face each other to form a space for transferring a fluid around inside the impeller part 110. That is, a path formed by the flow paths 141*c* and 142*c* includes a path for transferring the fluid from the first impeller 111 to the second impeller 112, a path for transferring the fluid from the third impeller 113 to the fourth impeller 114, a path for transferring the fluid from the fifth impeller 115 to the sixth impeller 116, and a path for transferring the fluid from the seventh impeller 117 to the eighth impeller 118.

Each of the upper housing 141 including the impeller container 141*a*, the gear train container 141*b*, and the flow path 141*c* and the lower housing 142 including the impeller container 142*a*, the gear train container 142*b*, and the flow path 142*c* is formed as a one-piece casting, respectively. That is, the upper housing 141 and the lower housing 142 are manufactured by using casting method.

In a process of manufacturing the upper housing 141, while forming the upper housing 141 in the one-piece casting, the impeller container 141*a*, the gear train container 141*b*, and the flow path 141*c* are formed in as a single body. The lower housing 142 is formed using the same method as the upper housing 141, in which shapes of the impeller container 142*a*, the gear train container 142*b*, and the flow path 142*c* of the lower housing 142 are formed to be symmetrical to those of the impeller container 141*a*, the gear train container 141*b*, and the flow path 141*c* of the upper housing 141, respectively.

In detail, in the process of manufacturing the upper housing 141, the impeller container 141*a*, the gear train container 141*b*, and the flow path 141*c* are formed as a single body all together using a single mold for casting the upper housing 141. In a process of manufacturing the lower housing 142, the impeller container 142*a*, the gear train container 142*b*, and the flow path 142*c* are formed in a single body all together using another single mold for casting the lower housing 142.

According to the present exemplary embodiment, the impeller container 141*a*, the gear train container 141*b*, and the flow path 141*c* are formed all together using the single mold for the upper housing 141 in the process of manufacturing the upper housing 141 and the impeller container 142*a*, the gear train container 142*b*, and the flow path 142*c* are formed all together using the single mold for the lower housing 142 in the process of manufacturing the lower housing 142, but the exemplary embodiment is not limited thereto. That is, at least one of the impeller containers 141*a* and 142*a*, the gear train containers 141*b* and 142*b*, and the flow paths 141*c* and 142*c* may be formed by an additional cutting process after a casting process is performed.

Since the impeller containers 141*a* and 142*a*, the gear train containers 141*b* and 142*b*, and the flow paths 141*c* and 142*c* of the housing 140 are formed in a single body by the casting process, there is no need to include a separate casing member, a shroud member, and a gearbox, which are used in compressor systems of the related art. Also, since the housing 140 includes the flow paths 141*c* and 142*c*, it is possible to greatly reduce the number of flow path pipes installed outside the housing 140.

The support 150 is installed on a bottom of the lower housing 142 and supports the lower housing 142. The support 150 is manufactured separately from the lower housing 142 and fastened to the lower housing 142 by using a method such as welding.

According to the present exemplary embodiment, the support 150 is manufactured separately from the lower housing 142 and fastened to the lower housing 142 by using a method such as welding, but the exemplary embodiment is not limited thereto. That is, the support 150 may be manufactured together with the lower housing 142 in a single casting while manufacturing the lower housing 142. In this case, a mold for the lower housing 142 includes a mold for the support 150.

Hereinafter, there will be described a method of manufacturing the compression system 100.

A manufacturer manufactures the upper housing 141 and the lower housing 142 in which the impeller containers 141*a* and 142*a*, the gear train containers 141*b* and 142*b*, and the flow paths 141*c* and 142*c* are also formed, respectively, by using a casting process. In addition, the manufacturer prepares elements of the impeller part 110 and the gear train 120 to be installed in the compression system 100.

The manufacturer arranges the prepared impeller part 110 in the impeller container 142*a* of the lower housing 142 and arranges the gear train 120 in the gear train container 142*b*, which have the shape as shown in FIG. 2.

The manufacturer couples the upper housing 141 with the lower housing 142 and fastens the upper and lower housings. In this case, a sealing means such as a sealing ring (not shown) is disposed between the upper housing 141 and the lower housing 142 to perform sealing. In this case, as a fastening means of the upper housing 141 and the lower housing 142, a screw-coupling method using bolts or a welding method may be used.

Hereinafter, operation of the compression system 100 will be described.

When a user starts driving the compression system 100, the main drive shaft 130 rotates. When the main drive shaft 130 rotates, the bull gear 121 rotates and the pinion gears 122 engaged with the bull gear 121 rotates.

When the pinion gears 122 rotate, the left and right shafts 110*c* rotate and the impeller part 110 rotates, thereby performing compression.

A fluid flowing into an inlet (not shown) of the compression system 100 is compressed sequentially as it passes through the first compression unit S1, the second compression unit S2, the third compression unit S3, and the fourth compression unit S4 of the multi-stage system and is discharged via an outlet (not shown) of the compression system 100.

As described above, according to the present exemplary embodiment, in the upper housing 141 and the lower housing 142 of the compression system 100, since the impeller containers 141*a* and 142*a*, the gear train containers 141*b* and 142*b*, and the flow paths 141*c* and 142*c* are formed as a single body, there is no need to include a separate casing member, a shroud member, or a gearbox member. Accordingly, a layout of an inner space of the compression system 100 is simplified in such a way that the number of manufacturing processes and the number of components may be reduced, thereby reducing manufacturing costs. Also, when designing the compression system 100, it is possible to efficiently arrange the inner space thereof to reduce a volume of the compression system 100 and to improve efficiency of an assembly process or servicing for maintenance. Additionally, since the compression system 100 may optimize flow paths therein and reduce a transfer distance, compression efficiency may be improved.

Particularly, in the case of the compression system 100, a plurality of impellers are arranged in tandem with one another. When there are a large number of impellers and an arrangement thereof is in tandem, it is important to simplify the layout of the inner space of the compression system to reduce manufacturing processes and manufacturing costs.

The compression system according to the present exemplary embodiment may have an inner configuration space whose layout is simple.

While exemplary embodiments have been particularly shown and described above, it will be understood by those of ordinary skill in the art that various changes in form and details may be made therein without departing from the spirit and scope of the present inventive concept as defined by the following claims.

What is claimed is:

1. A method of manufacturing a compression system, the method comprising:

preparing an upper housing and a lower housing, each of the upper and lower housings comprising an impeller container and a gear train container and a flow path configured to transfer a fluid amongst a plurality of impellers, the plurality of impellers including a first impeller, a second impeller, a third impeller and a fourth impeller, the first and the second impeller provided on a first side with respect to a main drive shaft transferring power to drive the side opposite to the first side with respect to the main drive shaft, the first and second impellers attached to a first shaft, the third and fourth impellers attached to a second shaft;

installing the plurality of impellers in the impeller container of the lower housing and installing a gear train in the gear train container of the lower housing; and coupling the upper housing with the lower housing, wherein the preparing the upper housing and the lower housing comprises casting each of the upper and lower housings having the impeller container, the gear train container and the flow path as a one-piece casting, wherein the impeller container, the gear train container and the flow path are formed all together using a single mold for each of the upper and lower housings in a casting process, and wherein the first and second shafts extend through an exterior of the one-piece casting of each of the upper and lower housings along an axial direction of the first and second shafts.

2. The method of claim 1, wherein the lower housing further comprises a support supporting the lower housing, and wherein the impeller container, the gear train container, the flow path and the support are formed all together using the single mold.

3. The method of claim 1, wherein the method further comprises:

providing a first connecting pipe configured to connect a first compression unit including the first impeller to a second compression unit including the second impeller;

providing a second connecting pipe configured to connect the second compression unit including the second impeller to a third compression unit including the third impeller; and providing a third connecting pipe configured to connect the third compression unit including the third impeller to a fourth compression unit including the fourth impeller, the first, second and third connecting pipes provided at an exterior of the upper and lower housings.

4. The method of claim 1, wherein the first and second shafts are supported by a first bearing and a second bearing, respectively, and wherein the first and second bearings are provided in the one-piece casting of each of the upper and lower housings.

* * * * *